US008515329B2

(12) United States Patent
Shimizu

(10) Patent No.: US 8,515,329 B2
(45) Date of Patent: Aug. 20, 2013

(54) IMAGE FORMING APPARATUS, SHEET-FEED CONTROL METHOD, AND COMPUTER PROGRAM PRODUCT

(75) Inventor: Kiichirou Shimizu, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 805 days.

(21) Appl. No.: 12/565,075

(22) Filed: Sep. 23, 2009

(65) Prior Publication Data

US 2010/0092189 A1 Apr. 15, 2010

(30) Foreign Application Priority Data

Oct. 10, 2008 (JP) ..... 2008-264057
Aug. 18, 2009 (JP) ..... 2009-189314

(51) Int. Cl.
*G03G 15/00* (2006.01)
*B65H 7/02* (2006.01)

(52) U.S. Cl.
USPC ..... 399/384; 399/389; 399/391; 399/392; 271/258.01; 271/259

(58) Field of Classification Search
USPC ..... 399/384, 389, 392, 393, 388, 391; 271/258.01, 258.03, 259
See application file for complete search history.

(56) References Cited

U.S. PATENT DOCUMENTS 5,734,958 A * 3/1998 Kazama et al. ..... 399/363
2006/0245780 A1* 11/2006 Yamada ..... 399/81

FOREIGN PATENT DOCUMENTS

JP 2004035189 A * 2/2004
JP 2004-238161 8/2004
JP 2005-178941 7/2005
JP 2005-348257 12/2005
JP 2006041809 A * 2/2006
JP 2006-343605 12/2006
JP 4019686 10/2007
JP 4059781 12/2007

OTHER PUBLICATIONS

Machine Translation of JP 2005178941 Motoyoshi, Tomoya Jul. 7, 2005.*

* cited by examiner

*Primary Examiner* — Matthew G Marini
*Assistant Examiner* — Allister Primo
(74) *Attorney, Agent, or Firm* — Oblon, Spivak, McClelland, Maier & Neustadt, L.L.P.

(57) ABSTRACT

A sheet is placed on a sheet feed unit. A main-scanning sensor detects first detection information for identifying a sheet size in a main-scanning direction and a sub-scanning sensor detects second detection information for identifying a sheet size in a sub-scanning direction. A sheet sensor detects presence of the sheet on the sheet feed unit. It is monitored whether the sheet sensor has detected a sheet and a timer starts counting a first elapsed time from a time point at which the sheet sensor detects a sheet. A size identifying unit identifies, when the first elapsed time exceeds a first predetermined set time, a sheet size based on the first and the second detection information.

7 Claims, 7 Drawing Sheets

IMAGE FORMING APPARATUS, SHEET-FEED CONTROL METHOD, AND COMPUTER PROGRAM PRODUCT

CROSS-REFERENCE TO RELATED APPLICATIONS

The present application claims priority to and incorporates by reference the entire contents of Japanese Patent Application No. 2008-264057 filed in Japan on Oct. 10, 2008 and Japanese Patent Application No. 2009-189314 filed in Japan on Aug. 18, 2009.

BACKGROUND OF THE INVENTION

1. Field of the Invention

The present invention relates to a technology for detecting and feeding sheets set in a tray in an image forming apparatus.

2. Description of the Related Art

Various apparatuses having print functions have been widely used. Such apparatuses include printers and multi function peripherals (MFP) having a copy function, a facsimile (FAX) function, a print function, and a scan function in one package. A typical MFP generally has a so-called manual sheet feed mode in which a user can set a sheet of a desired size and quality on a sheet feed device such as a tray. Such a sheet feed device generally includes fences in a main-scanning direction (on a front and a rear sides thereof) and a sub-scanning direction (on a left and a right sides thereof) to prevent the set sheets from getting misaligned in the main-scanning direction and the sub-scanning direction.

A technology for performing printing in the manual sheet feed mode is disclosed in, for example, Japanese Patent Application Laid-open No. 2005-178941. In this technology, lengths of sides in the main-scanning direction and the sub-scanning direction of each sheet set on the sheet feed device are detected before starting feeding the sheet, so that sheets of various sizes can be handled in a timely manner.

However, in the conventional technology, the sheet feed device may start feeding a sheet while a user is performing an action for placing a sheet on the sheet feed device, or the user is performing an action for aligning a sheet by using the fences. That is, a sheet may be fed while it is has not accurately been set on the sheet feed device.

Furthermore, when all the sheets in the sheet feed device have been fed, i.e., the sheet feed device becomes empty, and a user places a new sheet on the sheet feed device during the printing, similarly to the above, it may happen that a sheet cannot be accurately set on the sheet feed device.

Moreover, when a user sets a sheet of a wrong size on the sheet feed device when the sheet feed device is empty during the printing, the sheet may be fed to the MFP leading to a paper jam or the like.

SUMMARY OF THE INVENTION

It is an object of the present invention to at least partially solve the problems in the conventional technology.

According to an aspect of the present invention there is provided an image forming apparatus including an image forming unit that performs image forming processing on a sheet; a sheet feed unit having an arrangement for placing a sheet thereon and configured to feed the sheet to the image forming unit; a first sensor configured to detect first information indicative of a first size in a first direction of a sheet placed on the sheet feed unit; a second sensor configured to detect second information indicative of a second size in a second direction perpendicular to the first direction of a sheet placed on the sheet feed unit; a sheet sensor configured to detect presence or absence of a sheet on the sheet feed unit; a monitoring unit configured to monitor the sheet sensor so as to check whether the sheet sensor has detected presence of a sheet; a timer unit configured to begin counting a first time from a time point at which the sheet sensor detects presence of a sheet; an identifying unit configured to identify, when the first time exceeds a first set time, a size of the sheet based on the first information and the second information; and a control unit configured to control the sheet feed unit not to start feeding the sheet to the image forming unit until the identifying unit identifies the size of the sheet.

According to another aspect of the present invention there is provided a sheet-feed control method implemented on an image forming apparatus. The image forming apparatus including an image forming unit that performs image forming processing on a sheet; a sheet feed unit having an arrangement for placing a sheet thereon and configured to feed the sheet to the image forming unit; a first sensor configured to detect first information indicative of a first size in a first direction of a sheet placed on the sheet feed unit; a second sensor configured to detect second information indicative of a second size in a second direction perpendicular to the first direction of a sheet placed on the sheet feed unit; and a sheet sensor configured to detect presence or absence of a sheet on the sheet feed unit. The sheet-feed control method including monitoring the sheet sensor so as to check whether the sheet sensor has detected presence of a sheet; begin counting a first time from a time point at which the sheet sensor detects presence of a sheet; identifying, when the first time exceeds a first set time, a size of the sheet based on the first information and the second information; and controlling the sheet feed unit not to start feeding the sheet to the image forming unit until the size of the sheet is identified at the identifying.

According to still another aspect of the present invention there is provided a computer program product that includes a computer-readable recording medium storing therein a computer program which when executed on a computer causes the computer to realize a sheet-feed control method on an image forming apparatus. The image forming apparatus including an image forming unit that performs image forming processing on a sheet; a sheet feed unit having an arrangement for placing a sheet thereon and configured to feed the sheet to the image forming unit; a first sensor configured to detect first information indicative of a first size in a first direction of a sheet placed on the sheet feed unit; a second sensor configured to detect second information indicative of a second size in a second direction perpendicular to the first direction of a sheet placed on the sheet feed unit; and a sheet sensor configured to detect presence or absence of a sheet on the sheet feed unit. The sheet-feed control method including monitoring the sheet sensor so as to check whether the sheet sensor has detected presence of a sheet; begin counting a first time from a time point at which the sheet sensor detects presence of a sheet; identifying, when the first time exceeds a first set time, a size of the sheet based on the first information and the second information; and controlling the sheet feed unit not to start feeding the sheet to the image forming unit until the size of the sheet is identified at the identifying.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. In the description of the following embodiments, examples will be used in which an image forming apparatus, a sheet-feed control method, and a computer program product according to the present invention are applied to an apparatus having a print function, such as a multifunction peripheral (MFP) having a copy function, a facsimile (FAX) function, a print function, and a scan function in one package. However, the present invention can be applied to other apparatuses having at least print functions.

Figure 1:
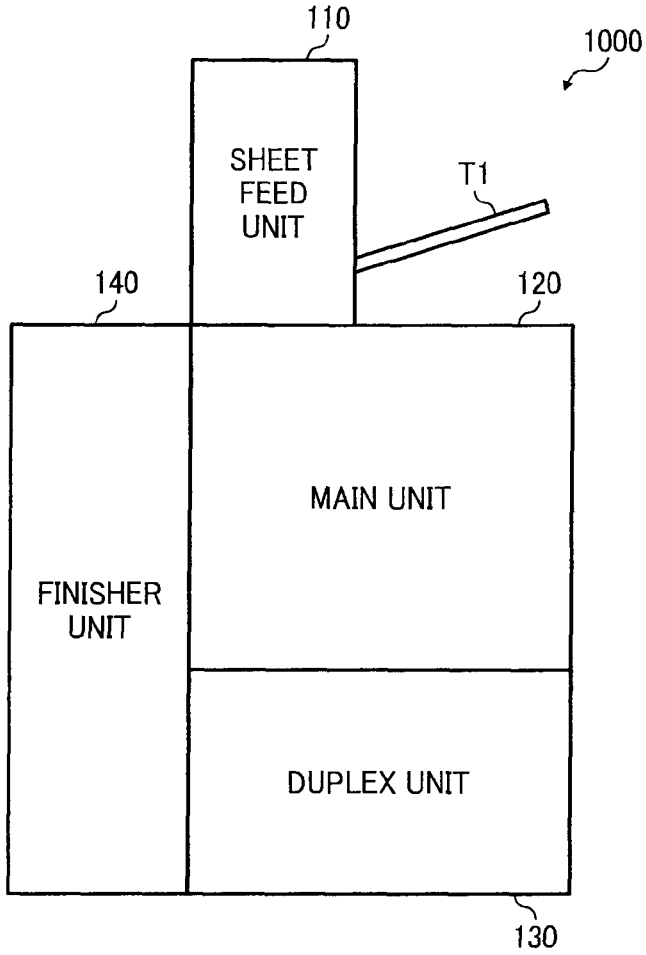
FIG. 1 is a schematic diagram of a general configuration of a multifunction peripheral (MFP) according to a first embodiment of the present invention.

FIG. 1 is a schematic diagram of a general configuration of an MFP 1000 according to a first embodiment of the present invention. The MFP 1000 includes a sheet feed unit 110, a main unit 120, a duplex unit 130, and a finisher unit 140.

The sheet feed unit 110 conveys sheets to the main unit 120 for printing an image thereon. The sheet feed unit 110 includes an automatic feed tray (not shown) for stacking sheets. The sheets shacked in the automatic feed tray are automatically fed to the main unit 120 one by one in the automatic sheet feed mode. The sheet feed unit 110 also includes a manual feed tray T1. A person manually places a sheet in the manual feed tray T1 and that sheet is fed to the main unit 120 in the manual sheet feed mode.

Figure 2:
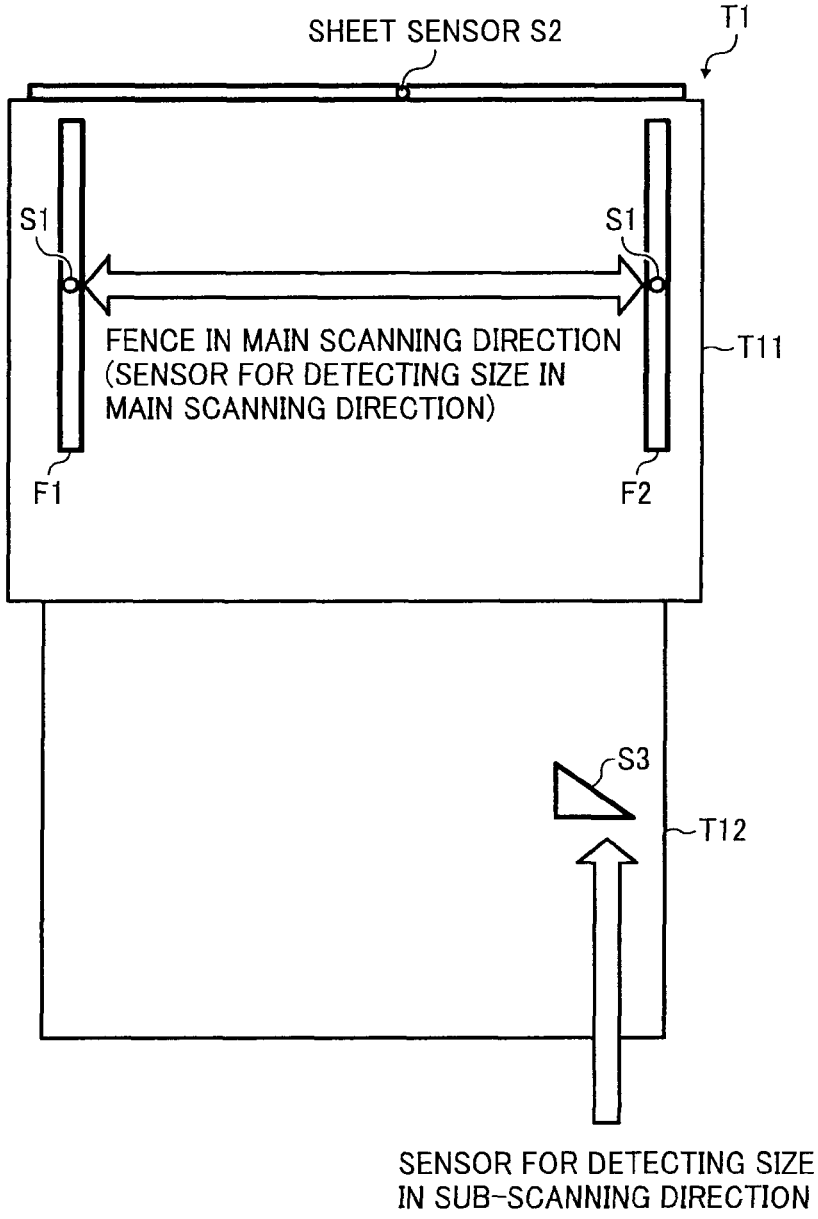
FIG. 2 is an overhead view of a manual feed tray shown in FIG. 1.

FIG. 2 is an overhead view of the manual feed tray T1 shown in FIG. 1. The manual feed tray T1 includes sheet feed tables T11 and T12 for placing a sheet thereon.

The sheet feed table T11 is provided with fences F1 and F2 for aligning the sheet and preventing the sheet from shifting in a main-scanning direction. The fences F1 and F2 are slidable in the main-scanning direction on the sheet feed table T11. Each of the fences F1 and F2 includes a main-scanning sensor S1 that detects information indicative of a size of the sheet in the main-scanning direction. Examples of the information indicative of the size of the sheet includes information about positions of the fences.

The sheet feed table T11 also includes a sheet sensor S2 that detects presence or absence of a sheet on the manual feed tray T1. The sheet sensor S2 is arranged at such a location that it is in contact with the sheet feed unit 110.

The sheet feed table T12 is in contact with the sheet feed table T11. Moreover, the sheet feed table T12 is slidable in a sub-scanning direction to prevent a sheet placed on the sheet feed table T11 from shifting in the sub-scanning direction.

The sheet feed table T12 includes a sub-scanning sensor S3. The sheet feed table T12 detects information indicative of a size of a sheet in the sub-scanning direction of a sheet placed on the manual feed tray T1. Because the position of the sub-scanning sensor S3 is known, when the sub-scanning sensor S3 detects a sheet on the manual feed tray T1 the size of the sheet can be determined. As will be described later, a size identifying unit 12013 identifies a sheet size based on information collected by the main-scanning sensors S1 and the sub-scanning sensor S3.

In the following descriptions, it is explained that the sub-scanning sensor S3 detects the presence or the absence of a sheet and the MFP 1000 identifies a sheet size based on the presence or the absence of the sheet, which is a detection result from the sub-scanning sensor S3, and the positions of the fences, which are detection results from the main-scanning sensors S1. However, it is possible to place the sub-scanning sensor S3 on each of the fences in the same manner as the main-scanning sensors S1 for identifying the sheet size. Returning to FIG. 1, the main unit 120 is described in detail below.

The main unit 120 performs various image forming processing such as scanning and printing with respect to a sheet conveyed from the sheet feed unit 110.

Figure 3:
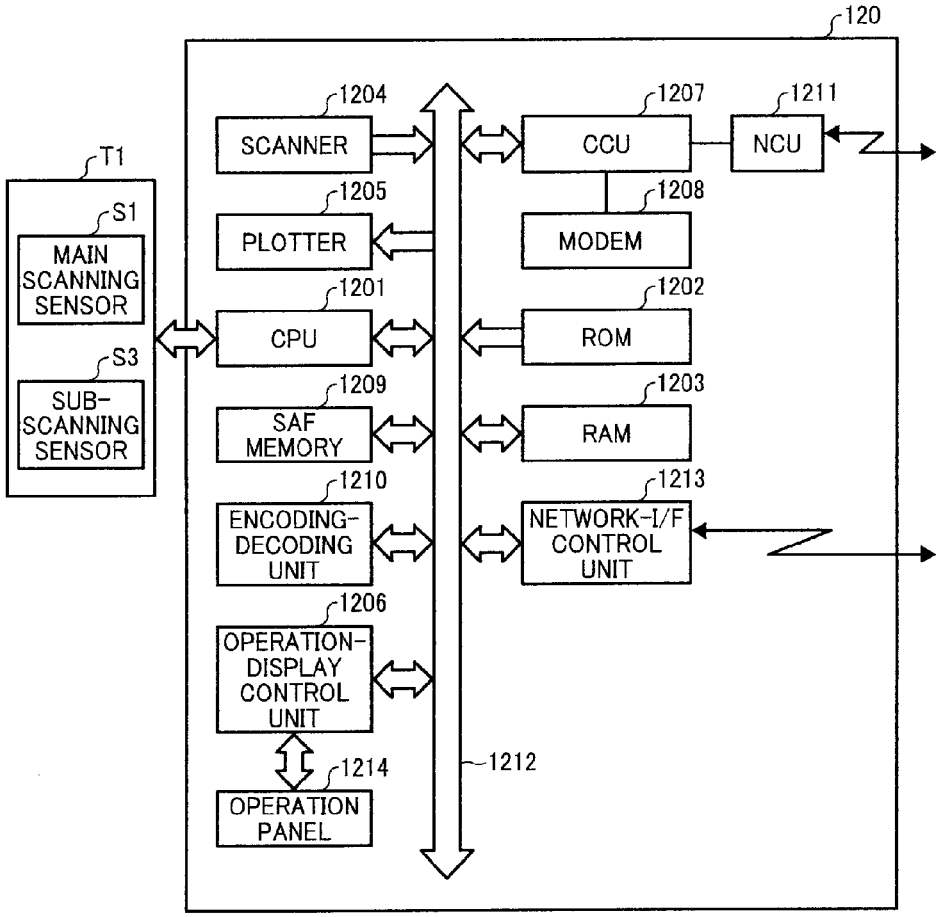
FIG. 3 is a schematic diagram of a hardware configuration of a main unit shown in FIG. 1.

FIG. 3 is a schematic diagram for explaining a hardware configuration of the main unit 120. The main unit 120 includes a central processing unit (CPU) 1201, a read only memory (ROM) 1202, a random access memory (RAM) 1203, a scanner 1204, a plotter 1205, an operation-display control unit 1206, a communication control unit (CCU) 1207, a modem 1208, a store and forward (SAF) memory 1209, an encoding-decoding unit 1210, a network control unit (NCU) 1211, a bus 1212, a network-interface (I/F) control unit 1213, and an operation panel 1214.

The CPU 1201 executes various processing for performing printing on sheets in the manual sheet feed mode, which will be described later.

The ROM 1202 is a storage medium for storing computer programs to be executed by a sensor monitoring unit 12011 and the size identifying unit 12013, which will be described later.

The RAM 1203 is a storage medium for storing a set time (a first set time and a second set time), a tentative sheet size that is tentatively identified by the size identifying unit 12013, and a confirmed sheet size that is confirmed by the size identifying unit 12013.

The operation-display control unit 1206 receives a set time (to be described later) designated by a user via the operation panel 1214 and stores the set time in the RAM 1203.

The CCU 1207 is a communication control device that performs FAX communication with other MFPs via a communication network.

The modem 1208 is a device that modulates a transmission signal and demodulates a reception signal when performing communication with other MFPs via the communication network.

The SAF memory 1209 is a storage medium such as a memory for storing image data that is obtained as a result of image processing performed by the scanner 1204 or the plotter 1205.

The encoding-decoding unit 1210 encodes image data stored in the SAF memory 1209 according to a predetermined encoding method and decodes encoded image data according to a predetermined decoding method.

The NCU 1211 transmits a dial signal for calling a communication destination apparatus when performing communication with other MFPs via the communication network.

The bus 1212 connects the CPU 1201, the ROM 1202, the RAM 1203, and the like to one another.

The network-I/F control unit 1213 includes a communication device such as a local area network (LAN) board (not shown), and controls communication performed by the CCU 1207, the NCU 1211, and the like via the communication network.

The operation panel 1214 includes a display device such as a liquid crystal display (LCD) (not shown), and receives an instruction for executing various processing such as scan processing and print processing from a user. The operation panel 1214 also receives an input of the set time (i.e., the first set time and the second set time) from a user. In this manner, a user is allowed to input the set time to the operation panel 1214 so that a time to be assured for tentatively identifying or confirming a sheet size can be adjusted as desired.

Figure 4:
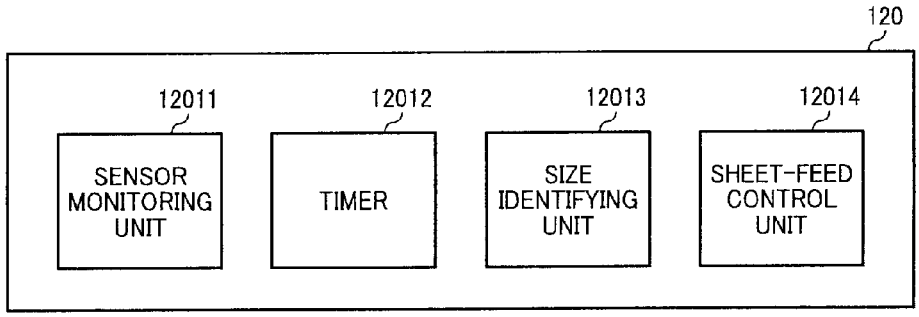
FIG. 4 is a block diagram of a functional configuration of the main unit shown in FIG. 1.

FIG. 4 is a block diagram of a functional configuration of the main unit 120. The main unit 120 mainly includes, as functional units, the sensor monitoring unit 12011, a timer 12012, the size identifying unit 12013, and a sheet-feed control unit 12014.

The sensor monitoring unit 12011 monitors whether the detection information detected by each of the main-scanning sensors S1 and the sub-scanning sensor S3 has changed. More specifically, the sensor monitoring unit 12011 monitors the detection information (i.e., a detection result) output from the main-scanning sensor S1 for a predetermined length of time, and, when contents of the detection information changes during the predetermined length of time, determines that the detection information output from the main-scanning sensor S1 has changed. Similarly, the sensor monitoring unit 12011 monitors the detection information (i.e., a detection result) output from the sub-scanning sensor S3 for a predetermined length of time, and, when contents of the detection information changes during the predetermined length of time, determines that the detection information output from the sub-scanning sensor S3 had changed.

When determining that the detection information output from each of the main-scanning sensors S1 and the sub-scanning sensor S3 has changed, the sensor monitoring unit 12011 continuously monitors whether the detection information output from each of the main-scanning sensors S1 and the sub-scanning sensor S3 further changes. On the other hand, when determining that the detection information output from each of the main-scanning sensors S1 and the sub-scanning sensor S3 has not changed, the sensor monitoring unit 12011 starts the timer 12012.

The sensor monitoring unit 12011 also monitors the sheet sensor S2 whether the sheet sensor S2 has detected presence of a sheet. Hereinafter, a state where the sheet sensor S2 has detected the presence of a sheet is referred to as "a sheet detected state".

Then, the sensor monitoring unit 12011 determines whether the detection information output from the sub-scanning sensor S3 has changed in the sheet detected state. When determining that the detection information output from the sub-scanning sensor S3 has changed, the sensor monitoring unit 12011 determines that the sheet size is not confirmed, and determines that the sheet size needs to be tentatively identified, which will be described later.

On the other hand, when determining that the detection information output from the sub-scanning sensor S3 has not changed in the sheet detected state, the sensor monitoring unit 12011 restarts the timer 12012.

The timer 12012 measures a time (a second elapsed time) elapsed since the sensor monitoring unit 12011 determines that the detection information output from each of the main-scanning sensors S1 and the sub-scanning sensor S3 has not changed. The timer 12012 also measures a time (a first elapsed time) elapsed since the timer 12012 is reset by the size identifying unit 12013, which will be described later.

The size identifying unit 12013 determines whether the elapsed time measured by the timer 12012 (i.e., the second elapsed time) has exceeded a predetermined set time (i.e., the second set time) that is stored in advance in the RAM 1203 and referred to for determining whether the sheet size is confirmed. The second set time can be set to be equal to a time generally taken by a user for setting a sheet on the manual feed tray T1 (e.g., three seconds or so).

When determining that the second elapsed time measured by the timer 12012 has exceeded the second set time, the size identifying unit 12013 identifies the sheet size based on the detection information output from each of the main-scanning sensors S1 and the sub-scanning sensor S3 at the time of the end of the second set time. In other words, the size identifying unit 12013 identifies the sheet size based on the positions of the fences and the presence or the absence of the sheet, which is a detection result from the sub-scanning sensor S3, at the time of the end of the second set time. Then, the size identifying unit 12013 stores the identified sheet size in the RAM 1203.

The size identifying unit 12013 identifies the sheet size in the following manner. That is, assuming that the main-scanning sensor S1 detects that the fences are located at positions where a width between the fences matches a height of an A4 landscape size sheet while the sub-scanning sensor S3 detects absence of a sheet, the size identifying unit 12013 identifies that a placed sheet is in the A4 landscape size. Furthermore, assuming that the main-scanning sensor S1 detects that the fences are located at positions where the width between the fences matches a height of an A4 landscape size sheet while the sub-scanning sensor S3 detects presence of a sheet, the size identifying unit 12013 identifies that a placed sheet is in an A3 portrait size. The above identification method is exemplary, i.e., other methods for identifying the sheet size can also be applied.

At the time of identification by the size identifying unit 12013 as described above, a sheet is not placed on the manual feed tray T1. Hereinafter, the identification of the sheet size when a sheet is not placed on the manual feed tray T1 is referred to as "tentative identification". After tentatively identifying the sheet size (hereinafter, "a tentative sheet size"), the size identifying unit 12013 resets the timer 12012. When determining that an elapsed time (i.e., the first elapsed time) measured by the timer 12012 has exceeded a predetermined set time (i.e., the first set time), the size identifying unit 12013 further identifies the sheet size in the same manner as the tentative identification. Similarly to the second set time, the first set time can be set to be equal to a time generally taken by a user for setting a sheet on the manual feed tray T1 (e.g., three seconds or so).

The size identifying unit 12013 updates the tentative sheet size that is stored in the RAM 1203 at the time of the tentative identification with the identified sheet size. The identification of the sheet size when the sheet is placed on the manual feed tray T1 is referred to as "confirming identification", and the sheet size identified through the confirming identification is referred to as "a confirmed sheet size".

The sheet-feed control unit 12014 controls sheet feed operation so that feed of a sheet placed on the manual feed tray T1 is not started until the size identifying unit 12013 confirms the sheet size and the elapsed time exceeds the set time.

After the size identifying unit 12013 confirms the sheet size, when the elapsed time exceeds the set time and the size identifying unit 12013 resets the timer 12012, the sheet-feed control unit 12014 controls the sheet feed operation so that feed of the sheet placed on the manual feed tray T1 is started.

Figure 5:
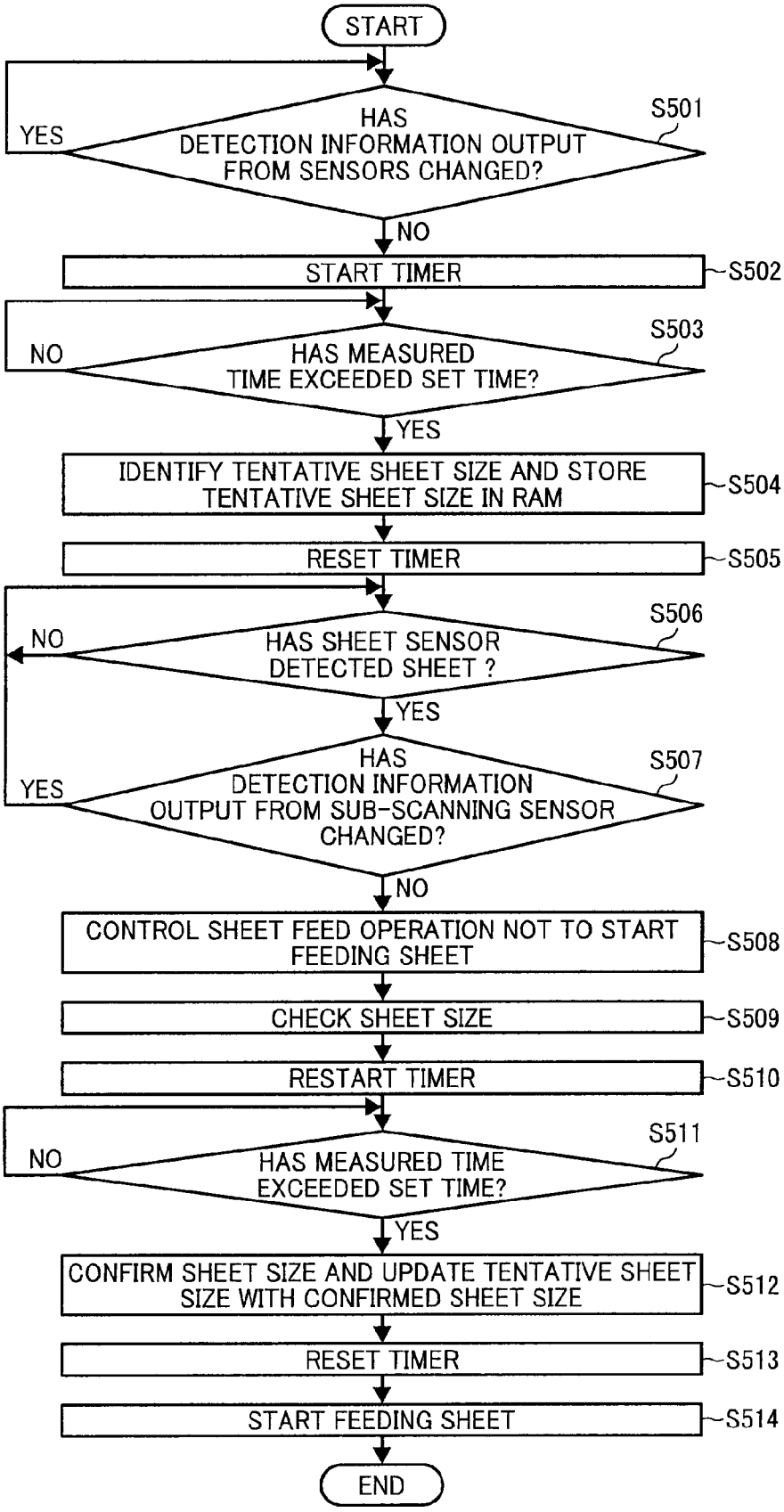
FIG. 5 is a flowchart of a sheet-feed control process according to the first embodiment.

A sheet-feed control process performed by the MFP 1000 is described below with reference to FIG. 5. FIG. 5 is a flowchart of the sheet-feed control process according to the first embodiment, which is performed before a user starts a printing process. In the following example, it is assumed that the user is adjusting the sheet feed tables T11 and T12 to set a sheet on the manual feed tray T1.

The sensor monitoring unit 12011 determines whether the detection information output from each of the main-scanning sensors S1 and the sub-scanning sensor S3 has changed (Step S501).

When determining that the detection information output from each of the main-scanning sensors S1 and the sub-scanning sensor S3 has changed (YES at Step S501), the sensor monitoring unit 12011 continuously monitors the detection information output from each of the main-scanning sensors S1 and the sub-scanning sensor S3.

On the other hand, when determining that the detection information output from each of the main-scanning sensors S1 and the sub-scanning sensor S3 has not changed (NO at Step S501), the sensor monitoring unit 12011 starts the timer 12012 (Step S502).

The size identifying unit 12013 determines whether the elapsed time (i.e., the second elapsed time) measured by the timer 12012 has exceeded the set time (i.e., the second set time) (Step S503).

When determining that the second elapsed time measured by the timer 12012 has exceeded the second set time (YES at Step S503), the size identifying unit 12013 identifies the tentative sheet size based on the detection information output from each of the main-scanning sensors S1 and the sub-scanning sensor S3 at the time of the end of the second set time, and stores the tentative sheet size in the RAM 1203 (Step S504).

After identifying the tentative sheet size, the size identifying unit 12013 resets the timer 12012 (Step S505).

The sensor monitoring unit 12011 then monitors whether the sheet sensor S2 has detected presence of the sheet (Step S506).

When determining that the sheet sensor S2 has not detected the presence of the sheet (NO at Step S506), the sensor monitoring unit 12011 stands by in a current state.

On the other hand, when determining that the sheet sensor S2 has detected the presence of the sheet (YES at Step S506), the sensor monitoring unit 12011 determines whether the detection information output from the sub-scanning sensor S3 has changed (Step S507). When determining that the detection information output from the sub-scanning sensor S3 has changed (YES at Step S507), the sensor monitoring unit 12011 determines that the sheet size is not confirmed, and process control returns to Step S506.

On the other hand, when the sensor monitoring unit 12011 determines that the detection information output from the sub-scanning sensor S3 has not changed (NO at Step S507), the sheet-feed control unit 12014 controls the sheet feed operation so that feed of the sheet placed on the manual feed tray T1 is not started (Step S508). The size identifying unit 12013 then checks the confirmed sheet size based on a current detection state of each of the main-scanning sensors S1 and the sub-scanning sensor S3 (Step S509).

The sensor monitoring unit 12011 restarts the timer 12012 (Step S510), and the size identifying unit 12013 determines whether the elapsed time (i.e., the first elapsed time) measured by the timer 12012 has exceeded the set time (i.e., the first set time) (Step S511). When determining that the first elapsed time measured by the timer 12012 has not exceeded the first set time (NO at Step S511), the sensor monitoring unit 12011 stands by in a current state.

On the other hand, when determining that the first elapsed time measured by the timer 12012 has exceeded the first set time (YES at Step S511), the size identifying unit 12013 confirms the sheet size based on the detection information output from each of the main-scanning sensors S1 and the sub-scanning sensor S3 at the end of the first set time, and updates the tentative sheet size that has been stored in the RAM 1203 with the confirmed sheet size (Step S512).

The size identifying unit 12013 resets the timer 12012 (Step S513), and the sheet-feed control unit 12014 controls the sheet feed operation so that feed of the sheet placed on the manual feed tray T1 is started (Step S514).

As described above, according to the first embodiment, the sensor monitoring unit 12011 determines whether the detection information detected by each of the main-scanning sensors S1 and the sub-scanning sensor S3 has changed and whether the sheet sensor S2 has detected the presence of a sheet; and the timer 12012 measures a time elapsed since the detection information detected by the sub-scanning sensor S3 does not change in the sheet detected state in which the sheet sensor S2 has detected the presence of a sheet. With this configuration, when a time measured by the timer 12012 exceeds the set time in such a situation that the sheet sensor S2 has detected the presence of a sheet and the detection information detected by the sub-scanning sensor S3 has not changed, the sheet size is identified based on the detection information detected by each of the main-scanning sensors S1 and the sub-scanning sensor S3. Therefore, a user can accurately and assuredly set a sheet (an original) on the manual sheet feed tray T1.

A second embodiment of the present invention will be described below. In the first embodiment, the sheet-feed control process is performed so that the printing process can be started after a user has adjusted the manual feed tray T1 to complete setting of a sheet. However, there may be a case where a user may set a sheet of a wrong size when the manual feed tray T1 becomes empty after the printing process has been started, resulting in a paper jam or the like. A sheet-feed control process according to the second embodiment is capable of accurately and assuredly setting a sheet to thereby carry on a printing process even when a printing process is paused due to running out of sheets during the printing process.

Figure 6:
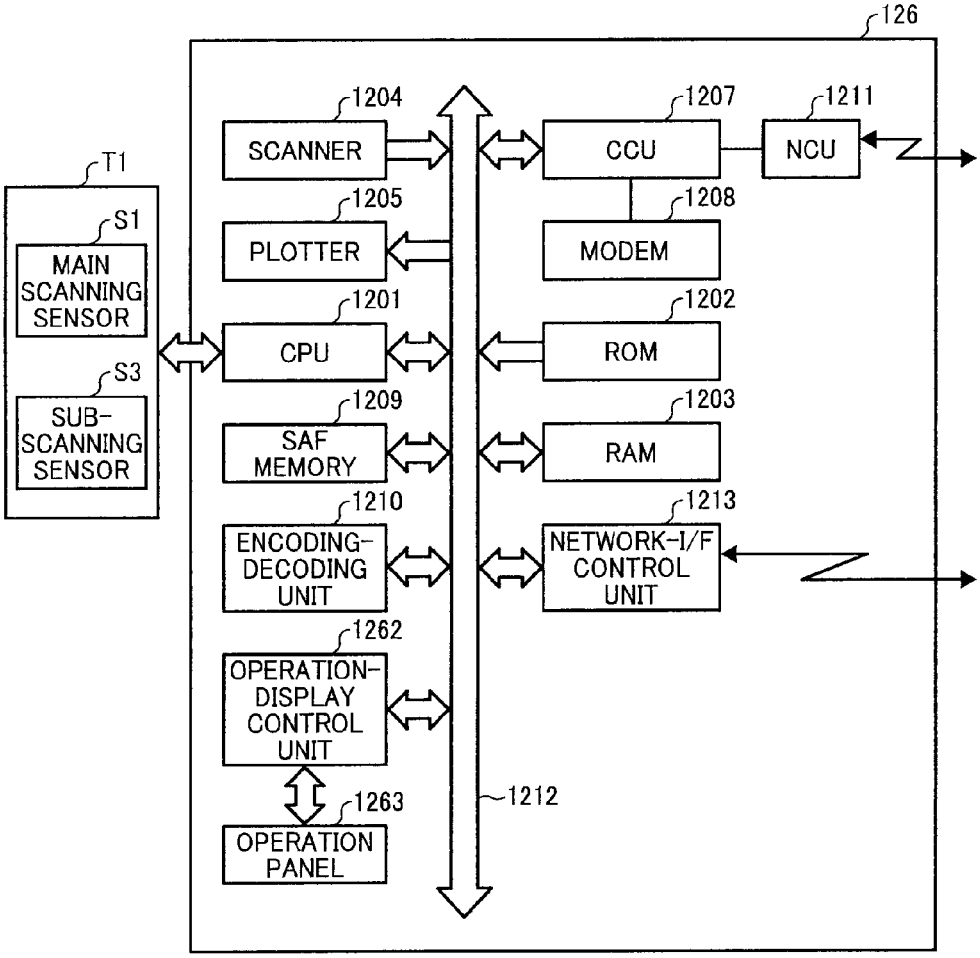
FIG. 6 is a schematic diagram of a hardware configuration of a main unit of an MFP according to a second embodiment of the present invention.

FIG. 6 is a schematic diagram for explaining a hardware configuration of a main unit 126 according to the second embodiment. The main unit 126 can be employed instead of the main unit 120 in the configuration shown in FIG. 1. The main unit 126 is different from the main unit 120 of the first embodiment in that it includes an operation-display control unit 1262 that is different from the operation-display control unit 1206 of the first embodiment and an operation panel 1263 that is different from the operation panel 1214 of the first embodiment. The same components as those of the first embodiment are denoted with the same reference numerals and symbols, and the explanation thereof is omitted.

The operation-display control unit 1262 performs the following process in addition to the process described in the first embodiment. That is, when a sensor monitoring unit 12611, which will be described later, determines that the detection information detected by either the main-scanning sensors S1 or the sub-scanning sensor S3 has changed, because the fences may be shifted from respective designated positions or a wrong size sheet may be set, the operation-display control unit 1262 displays on the operation panel 1263 an alert screen for instructing a user to set a correct size sheet, and stops a printing process.

The operation panel 1263 displays thereon the above-mentioned alert screen in addition to the same display contents as described in the first embodiment. By displaying the alert screen on the operation panel 1263, it is possible to prevent a paper jam caused by a wrong size sheet set by a user.

Figure 7:
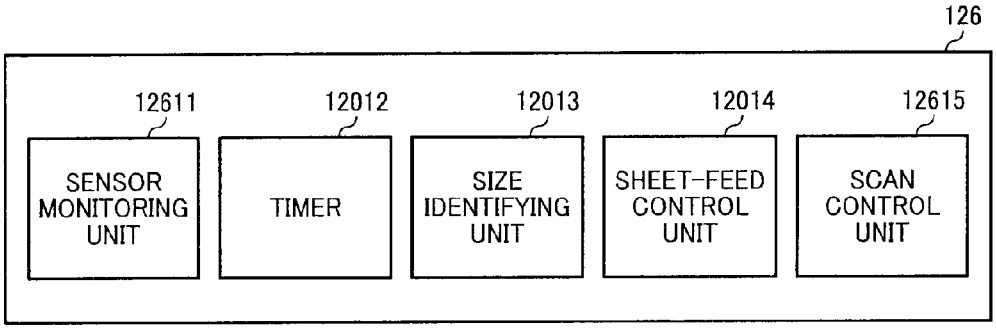
FIG. 7 is a block diagram of a functional configuration of the main unit shown in FIG. 6.

FIG. 7 is a block diagram of a functional configuration of the main unit 126. The main unit 126 is different from the main unit 120 of the first embodiment in that it includes the sensor monitoring unit 12611 that is different from the sensor monitoring unit 12011 and a scan control unit 12615 that is not included in the main unit 120 of the first embodiment.

The sensor monitoring unit 12611 performs the following processes in addition to the same processes as those performed by the sensor monitoring unit 12011 of the first embodiment. That is, when the manual feed tray T1 becomes empty after a printing process has been started, the sensor monitoring unit 12611 determines whether the detection information detected by either the main-scanning sensors S1 or the sub-scanning sensor S3 has changed, that is, whether a sheet size has been changed. When determining that the detection information detected by the sub-scanning sensor S3 has not changed, the sensor monitoring unit 12611 starts the timer 12012, and the same subsequent processes as those of the first embodiment are performed.

On the other hand, when determining that the detection information detected by either the main-scanning sensors S1 or the sub-scanning sensor S3 has changed, the sensor monitoring unit 12611 identifies the sheet size based on the detection information that is detected by each of the main-scanning sensors S1 and the sub-scanning sensor S3 before the detection information has changed, and stores the identified sheet size in the RAM 1203. Hereinafter, the sheet size identified in this manner is referred to as "a previous sheet size".

When determining that the detection information detected by either the main-scanning sensors S1 or the sub-scanning sensor S3 has changed, the scan control unit 12615 causes the scanner 1204 to continue read operation according to the previous sheet size that is stored in the RAM 1203. In this manner, the read operation can be performed according to the previous sheet size even when the manual feed tray T1 becomes empty during a printing process and the detection information detected by either the main-scanning sensors S1 or the sub-scanning sensor S3 has changed. Thus, it is possible to perform the printing process smoothly even when the sheet size has been changed.

For example, assuming that the printing process is performed on A3 portrait size sheets and when the manual feed tray T1 becomes empty during the printing process, the detection information output from the sub-scanning sensor S3 changes from "sheet detection" to "no-sheet detection" just after the manual feed tray T1 becomes empty. As a result, the sheet size employed for the printing process is changed to an A4 landscape size. However, in the second embodiment, because the previous sheet size is stored in the RAM 1203 or the like, a scanning process can be continuously performed according to the A3 portrait size that is designated before the manual feed tray T1 becomes empty.

Furthermore, assuming that the printing process is performed on A4 landscape size sheets and the manual feed tray T1 becomes empty during the printing process, and if a user erroneously places an A3 portrait size sheet on the manual feed tray T1, the detection information output from the sub-scanning sensor S3 changes from "no-sheet detection" to "sheet detection". However, in this case, the operation-display control unit 1262 displays on the operation panel 1263 the alert screen for instructing the user to set a correct size sheet, so that the user can re-set an A4 landscape size sheet that is designated before the manual feed tray T1 becomes empty. Therefore, a scanning process can be continued according to the previous sheet size. As a result, the printing process can be accurately and continuously performed.

Moreover, when the manual feed tray T1 becomes empty during the printing process and a user accordingly places new sheets on the manual feed tray T1, there may be a case where the user moves the fences in the main-scanning direction to widen a width between the fences in the main-scanning direction so that the user can easily place the new sheets. In this case, the positions of the fences indicated by the detection information output from the main-scanning sensors S1 are changed before and after the manual feed tray T1 becomes empty. However, in the second embodiment, the operation-display control unit 1262 displays on the operation panel 1263 the alert screen for instructing the user to set a correct size sheet, so that the user can re-set correct size sheets. Therefore, a scanning process can be continued according to the previous sheet size. As a result, the printing process can be accurately and continuously performed.

Figure 8A:
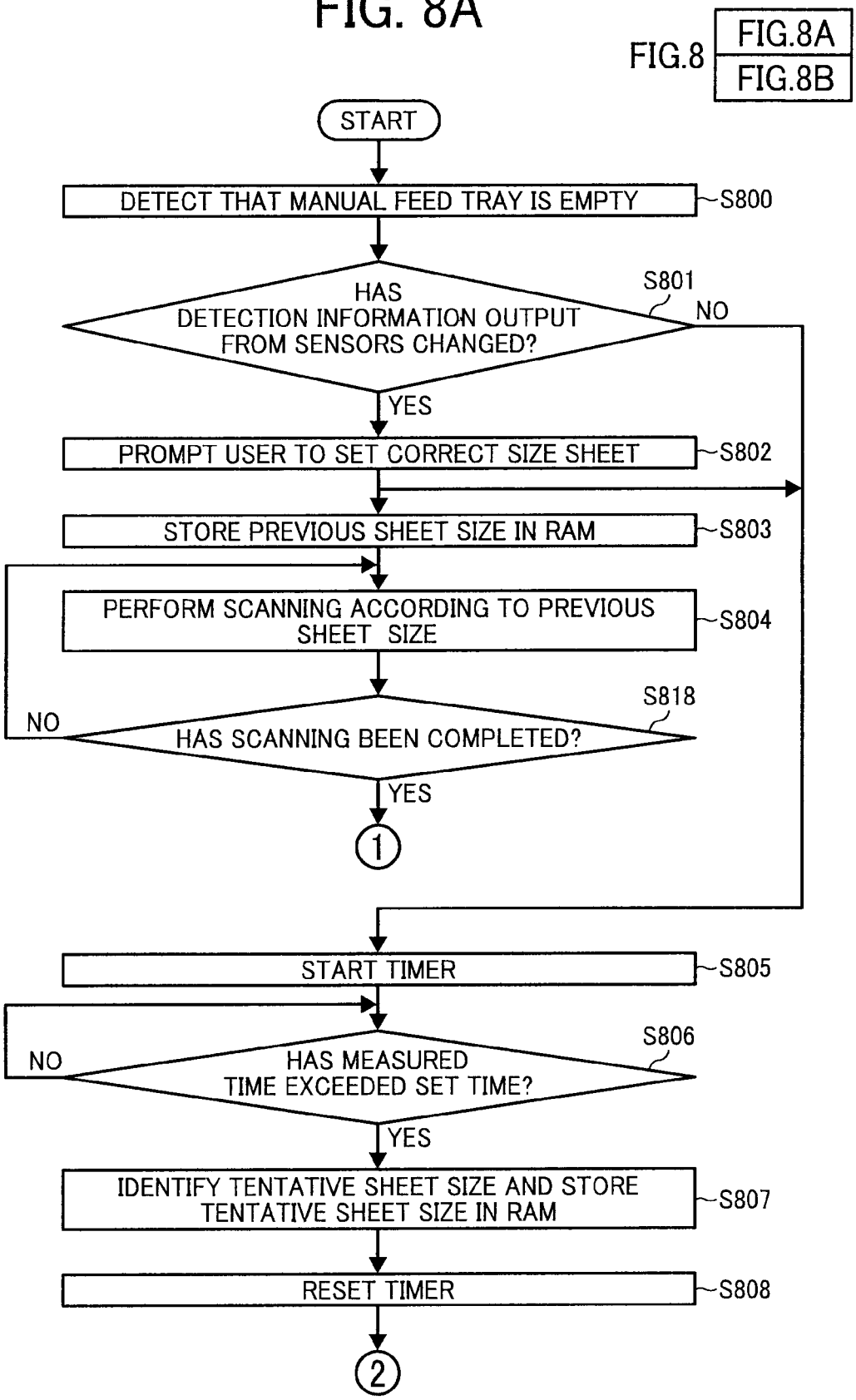
FIG. 8 is a flowchart of a sheet-feed control process according to the second embodiment.
Figure 8B:
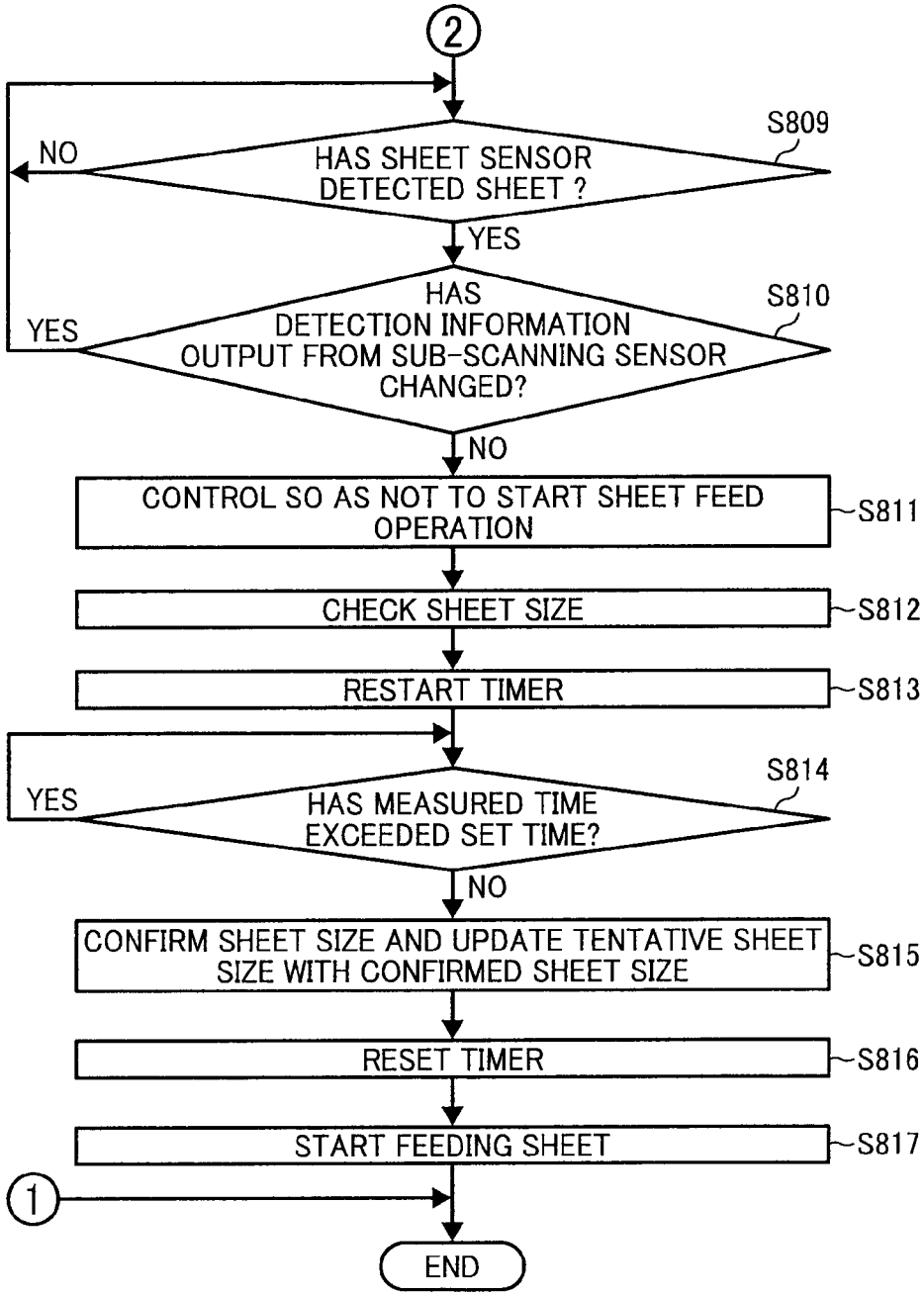

The sheet-feed control process performed by the MFP 1000 according to the second embodiment is described below with reference to FIG. 8. FIG. 8 is a flowchart of the sheet-feed control process according to the second embodiment. The sheet-feed control process according to the second embodiment is different from that of the first embodiment in that the MFP 1000 of the second embodiment determines whether the sheet size has been changed by determining whether the detection information output from either the main-scanning sensors S1 or the sub-scanning sensor S3 has changed when the MFP runs out of sheets during the printing process. In the following example, it is assumed that the manual feed tray T1 becomes empty after a printing process has started, and a user accordingly sets a new sheet on the manual feed tray T1 during the printing process.

When the sheet sensor S2 detects the absence of sheets on the manual feed tray T1, that is when the manual feed tray T1 becomes empty (Step S800), the user generally sets a new sheet on the manual feed tray T1. At this time, the sensor monitoring unit 12611 determines whether the detection information detected by either the main-scanning sensors S1 or the sub-scanning sensor S3 has changed to determine whether the fences are moved or a wrong size sheet is set (Step S801).

When determining that the detection information detected by either the main-scanning sensors S1 or the sub-scanning sensor S3 has not changed (NO at Step S801), the sensor monitoring unit 12611 starts the timer 12012 and performs the same subsequent processes as those performed at Steps S506 to S514 (Steps S805 to S817).

On the other hand, when determining that the detection information detected by either the main-scanning sensors S1 or the sub-scanning sensor S3 has changed (YES at Step S801), because the fences may be moved from respective designated positions or a wrong size sheet may be set, the operation-display control unit 1262 displays on the operation panel 1263 the alert screen for instructing the user to set a correct size sheet (Step S802).

Subsequently, a scanning process at Steps S803, S804, and 5818, and the sheet-feed control process at Steps S805 to S817 are performed in parallel.

In the scanning process, the sensor monitoring unit 12611 identifies the previous sheet size that is the sheet size obtained before the detection information output from either the main-scanning sensors S1 or the sub-scanning sensor S3 changes, and stores the previous sheet size in the RAM 1203 (Step S803).

The scan control unit 12615 then causes the scanner 1204 to continue read operation according to the previous sheet size that is stored in the RAM 1203 (Step S804). The scan control unit 12615 then determines whether the scanning process has been completed (Step S818). The scan control unit 12615 continues the scanning process according to the previous sheet size until the scanning process is completed (NO at Step S818, and Step S804). When it is determined that the scanning process has been completed (YES at Step S818), the scanning process is completed.

Meanwhile, after the alert screen is displayed at Step S802, the timer 12012 is started and the same processes as those performed at Steps S506 to 5514 are performed in parallel to the scanning process at Steps S803, S804, and S818 (Steps S805 to S817). In other words, the user who looks at the alert screen is instructed to set, on the manual feed tray T1, a sheet in the sheet size that is designated before all sheets on the manual feed tray T1 are user up. Thus, the sheet-feed control process at this time is performed in the same manner as the first embodiment.

As described above, according to the second embodiment, when the sensor monitoring unit 12611 determines that the detection information detected by either the main-scanning sensors S1 or the sub-scanning sensor S3 has changed during image processing (e.g., a printing process), the operation-display control unit 1262 displays on the operation panel 1263 the alert screen for instructing a user to set a correct size sheet on assumption that the fences are moved from respective designated guide positions. Therefore, even when the MFP runs out of sheets during a printing process, it is possible to prevent a user from setting a wrong size sheet, resulting in preventing a paper jam. As a result, the printing process can be accurately and assuredly performed.

A sheet-feed control program that implements the sheet-feed control process by the MFPs 1000 of the first and the second embodiments can be stored in advance in the ROM 1202, and provided as a computer program product.

Furthermore, the sheet-feed control program to be executed by the MFPs according to the first and the second embodiments can be stored in another computer connected to the MFP via a network such as the Internet such that the sheet-feed control program can be downloaded to the MFP via the network. Moreover, the sheet-feed control program to be executed by the MFP can be provided or distributed via a network such as the Internet.

The sheet-feed control program to be executed by the MFP is made up of modules that implements units of each of the main units 120 and 126 (i.e., the sensor monitoring units 12011 and 12611, the timer 12012, the size identifying unit 12013, the sheet-feed control unit 12014, and the scan control unit 12615). As actual hardware, when the CPU 1201 reads and executes the sheet-feed control program from the ROM 1202, the above modules are loaded and created on a main memory such as the RAM 1203 thereby implementing the units, i.e., the sensor monitoring units 12011 and 12611, the timer 12012, the size identifying unit 12013, the sheet-feed control unit 12014, and the scan control unit 12615.

As described above, the image forming apparatus according to the present invention has an advantage that it can accurately detect a sheet size to perform image forming processing. Specifically, the advantage of the image forming apparatus according to the present invention can be more effectively achieved when the image forming apparatus performs image forming processing in the manual sheet feed mode.

According to an aspect of the present invention, it is possible to accurately and assuredly set a sheet (an original) on a sheet feed device.

Furthermore, according to another aspect of the present invention, it is possible to accurately and assuredly set a sheet (an original) on the sheet feed device to continue a printing process even when the sheet feed device runs out of sheets during the printing process.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit that performs image forming processing on a sheet;

a sheet feed unit having an arrangement for placing a sheet thereon and configured to feed the sheet to the image forming unit;

a first sensor configured to detect first information indicative of a first size in a first direction of a sheet placed on the sheet feed unit;

a second sensor configured to detect second information indicative of a second size in a second direction perpendicular to the first direction of a sheet placed on the sheet feed unit;

a sheet sensor configured to detect presence or absence of a sheet on the sheet feed unit;

a monitoring unit configured to monitor the sheet sensor so as to check whether the sheet sensor has detected presence of a sheet;

a timer unit configured to begin counting a first time from a time point at which the sheet sensor detects presence of a sheet;

an identifying unit configured to identify, when the first time exceeds a first set time, a size of the sheet based on the first information and the second information; and a control unit configured to control the sheet feed unit not to start feeding the sheet to the image forming unit until the identifying unit identifies the size of the sheet, wherein the monitoring unit monitors whether the second information output from the second sensor has changed or has not changed, the monitoring unit monitors whether the first information output from the first sensor has changed or has not changed, the timer unit begins counting a second time from a time point at which the monitoring unit determines that both the first information and the second information have not changed, and the identifying unit tentatively identifies a tentative size of the sheet based on at least one of the first information and the second information when the second time exceeds a second set time.

2. The image forming apparatus according to claim 1, wherein the monitoring unit monitors whether the sheet sensor has detected presence of the sheet after the identifying unit has identified the tentative size of the sheet, the timer unit begins counting the first time from a time point at which the sheet sensor detects presence of the sheet and the identifying unit has identified the tentative size of the sheet, the identifying unit confirms the tentative size of the sheet based on both the first information and the second information when the first time exceeds the first set time, and the control unit controls the sheet feed unit not to start feeding the sheet to the image forming unit until the identifying unit confirms the tentative size of the sheet.

3. The image forming apparatus according to claim 1, further comprising:

a scanning unit configured to scan the sheet fed by the sheet feed unit;

a scan control unit configured to control operation of the scanning unit; and a storage unit configured to store therein a size of the sheet specified at the time of scanning the sheet, wherein the monitoring unit monitors whether at least one of the first information and the second information has changed, and the scan control unit controls the scanning unit to read the sheet according to the size stored in the storage unit even when the sheet feed unit pauses sheet feed operation after the image forming processing has started and when at least one of the first information and the second information has changed.

4. The image forming apparatus according to claim 3, further comprising:

an output unit that outputs information; and an output control unit that outputs to the output unit a notice indicating that a sheet needs to be set correctly when the sheet feed unit pauses the sheet feed operation because the sheet feed unit becomes empty after the image forming processing has started and when at least one of the first information and the second information has changed.

5. The image forming apparatus according to claim 1, further comprising an input receiving unit that receives input of at least one of the first set time and the second set time from a user.

6. A sheet-feed control method implemented on an image forming apparatus, the image forming apparatus including an image forming unit that performs image forming processing on a sheet; a sheet feed unit having an arrangement for placing a sheet thereon and configured to feed the sheet to the image forming unit; a first sensor configured to detect first information indicative of a first size in a first direction of a sheet placed on the sheet feed unit; a second sensor configured to detect second information indicative of a second size in a second direction perpendicular to the first direction of a sheet placed on the sheet feed unit; and a sheet sensor configured to detect presence or absence of a sheet on the sheet feed unit, the sheet-feed control method comprising:

monitoring the sheet sensor so as to check whether the sheet sensor has detected presence of a sheet;

begin counting a first time from a time point at which the sheet sensor detects presence of a sheet;

identifying, when the first time exceeds a first set time, a size of the sheet based on the first information and the second information; and controlling the sheet feed unit not to start feeding the sheet to the image forming unit until the size of the sheet is identified at the identifying, wherein the sheet-feed control method further comprises:

monitoring whether the second information output from the second sensor has changed or has not changed, monitoring whether the first information output from the first sensor has changed or has not changed, begin counting a second time from a time point at which the monitoring unit determines that both the first information and the second information have not changed, and identifying a tentative size of the sheet based on at least one of the first information and the second information when the second time exceeds a second set time.

7. A computer program product comprising a non-transitory computer-usable medium having a computer program which when executed on a computer causes the computer to realize a sheet-feed control method on an image forming apparatus, the image forming apparatus including an image forming unit that performs image forming processing on a sheet; a sheet feed unit having an arrangement for placing a sheet thereon and configured to feed the sheet to the image forming unit; a first sensor configured to detect first information indicative of a first size in a first direction of a sheet placed on the sheet feed unit; a second sensor configured to detect second information indicative of a second size in a second direction perpendicular to the first direction of a sheet placed on the sheet feed unit; and a sheet sensor configured to detect presence or absence of a sheet on the sheet feed unit, the sheet-feed control method comprising:

monitoring the sheet sensor so as to check whether the sheet sensor has detected presence of a sheet;

begin counting a first time from a time point at which the sheet sensor detects presence of a sheet;

identifying, when the first time exceeds a first set time, a size of the sheet based on the first information and the second information; and controlling the sheet feed unit not to start feeding the sheet to the image forming unit until the size of the sheet is identified at the identifying, wherein the sheet-feed control method further comprises:

monitoring whether the second information output from the second sensor has changed or has not changed, monitoring whether the first information output from the first sensor has changed or has not changed, begin counting a second time from a time point at which the monitoring unit determines that both the first information and the second information have not changed, and identifying a tentative size of the sheet based on at least one of the first information and the second information when the second time exceeds a second set time.

* * * * *